United States Patent [19]

Keys et al.

[11] Patent Number: 4,604,300

[45] Date of Patent: Aug. 5, 1986

[54] METHOD FOR APPLYING HIGH SOLIDS ENAMELS TO MAGNET WIRE

[75] Inventors: Steven F. Keys, Columbia City; Dennis L. Peppler, Fort Wayne, both of Ind.

[73] Assignee: Essex Group, Inc., Fort Wayne, Ind.

[21] Appl. No.: 719,395

[22] Filed: Apr. 3, 1985

[51] Int. Cl.[4] ..... B05D 5/12

[52] U.S. Cl. ..... 427/120; 427/429; 118/234; 118/266; 118/271

[58] Field of Search ..... 427/120, 428, 429; 118/264, 266, 268, 271, 234

[56] References Cited

U.S. PATENT DOCUMENTS

| | | | |
|---|---|---|---|
| 2,032,950 | 3/1936 | Newton et al. | 91/39 |
| 3,034,477 | 5/1962 | Williams | 118/223 |
| 3,145,121 | 8/1964 | Kraft | 118/271 |
| 3,199,492 | 8/1965 | Latour | 118/123 |
| 3,412,709 | 11/1968 | Goyffon | 118/405 |
| 3,877,414 | 4/1975 | Brideau et al. | 118/234 |
| 3,931,418 | 1/1976 | Risken | 427/120 |
| 4,096,291 | 6/1978 | Dunwald | 427/120 |
| 4,147,817 | 4/1979 | Janssen | 427/120 |
| 4,150,190 | 4/1979 | Walrath | 427/120 |
| 4,258,646 | 3/1981 | Kloczewski et al. | 118/50.1 |
| 4,360,543 | 11/1982 | JanBen | 427/120 |
| 4,389,457 | 6/1983 | Pauze | 427/120 |
| 4,447,472 | 5/1984 | Minnick | 427/120 |
| 4,476,279 | 10/1984 | McGregor | 427/120 |

*Primary Examiner*—Richard Bueker

*Attorney, Agent, or Firm*—Alan C. Cohen

[57] ABSTRACT

The present invention is for a method of applying high solids enamel coatings to magnet wire. The method comprises reducing the viscosity of the enamel to a processable range and then applying the heated enamel to the wire via a felt applicator. The coated wire is then passed through an oven where the enamel is cured. This method provides a process for applying high solids, viscous enamels to fine magnet wire substrates without the disadvantages of solvent dilution. The result is higher quality coatings, faster processing time and reduced process costs.

5 Claims, 3 Drawing Figures

FIG. 3
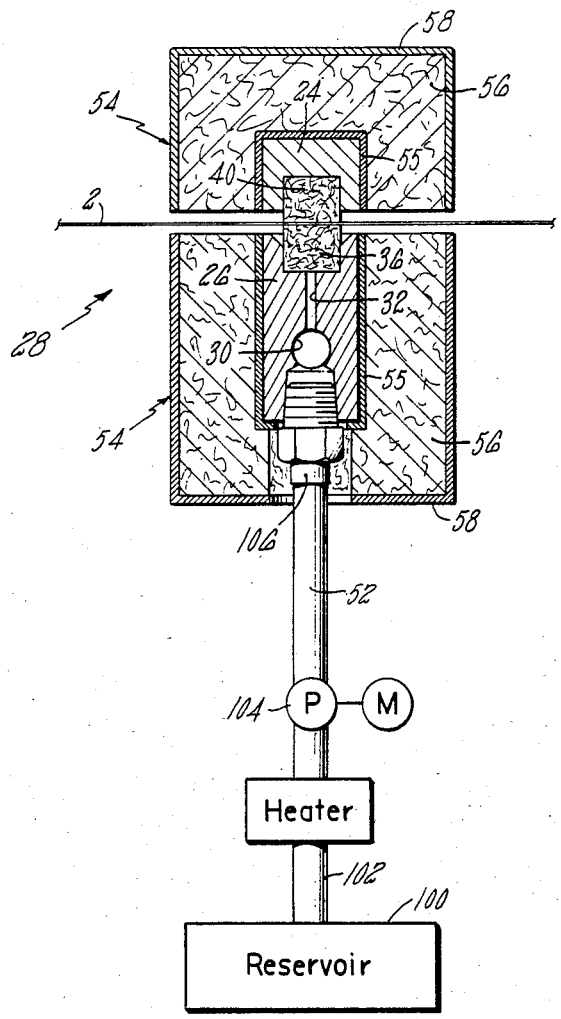
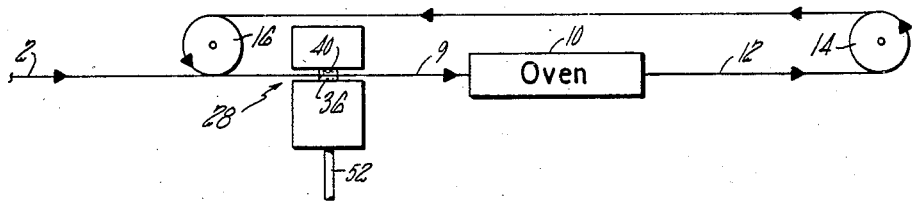
FIG. 1

METHOD FOR APPLYING HIGH SOLIDS ENAMELS TO MAGNET WIRE

TECHNICAL FIELD

The field of art to which this invention pertains is coating methods, and specifically to methods of applying polymer insulation to magnet wire substrates.

BACKGROUND ART

There has been a trend in the coating art in general to attempt to utilize coating compositions which contain higher and higher solids content. In addition to utilizing less solvent to prepare the coating compositions, less energy is required to drive off the solvents during the curing stage after the composition has been applied to the substrate. However, the higher solids content composition can cause countless problems both in handling prior to the application to the substrate and in the actual application of the coating composition. This poses particular problems when the application of the enamel to the wire is done using felt applicators, which in some applications is the preferred technique.

This preferred technique, which gives best results, utilizes a felt pad to uniformly, concentrically apply the enamel to the substrate wire. Only those enamels which flow smoothly and evenly through the felt and onto the wire can be used. Typically, the viscosity of these materials has to be below 40 centipoise (cps). Enamels with high viscosities will clog the felt pad thereby restricting the flow of the enamel through the felt pad onto the wire. This will result in lower wire speeds and lower builds than desired. Since most of the polymers do not have viscosities within the prescribed range, they are diluted with a solvent, thereby lowering their solids content considerably. These solvents necessitate increased costs, produced environmental and occupational hazards as well as an increase in the number of passes through the applicator required to attain the desired thicknesses of the coating.

Accordingly, what is needed in this art is a coating method particularly adapted to coating magnet wire which overcomes such problems.

DISCLOSURE OF INVENTION

The present invention is directed toward a method of applying magnet wire enamels to electrically conducting wire utilizing a high solids content, high viscosity, polymer coating composition. The method comprises heating the high solids content, viscous coating enamel to reduce its viscosity to below about 200 cps, then introducing the heated enamel into an applicator body, wherein the enamel is wicked onto one or more felt pads. The magnet wire is then drawn through the applicator die where it makes contact with the felt pad applicators and is coated with the heated enamel. The enamel utilized may have a solids content as low as about 6% to a high of about 100% and may be heated to lower its viscosity below 200 cps without damaging the enamel or the wire.

The foregoing and other features and advantages of the present invention will become more apparent from the following description and accompanying drawings.

BRIEF DESCRIPTION OF THE DRAWINGS

FIG. 1 shows a multiple pass applicator die process useful in practicing the invention.

FIG. 3 shows a cross section of a portion of the applicator die.

BEST MODE FOR CARRYING OUT THE INVENTION

Figure 2:
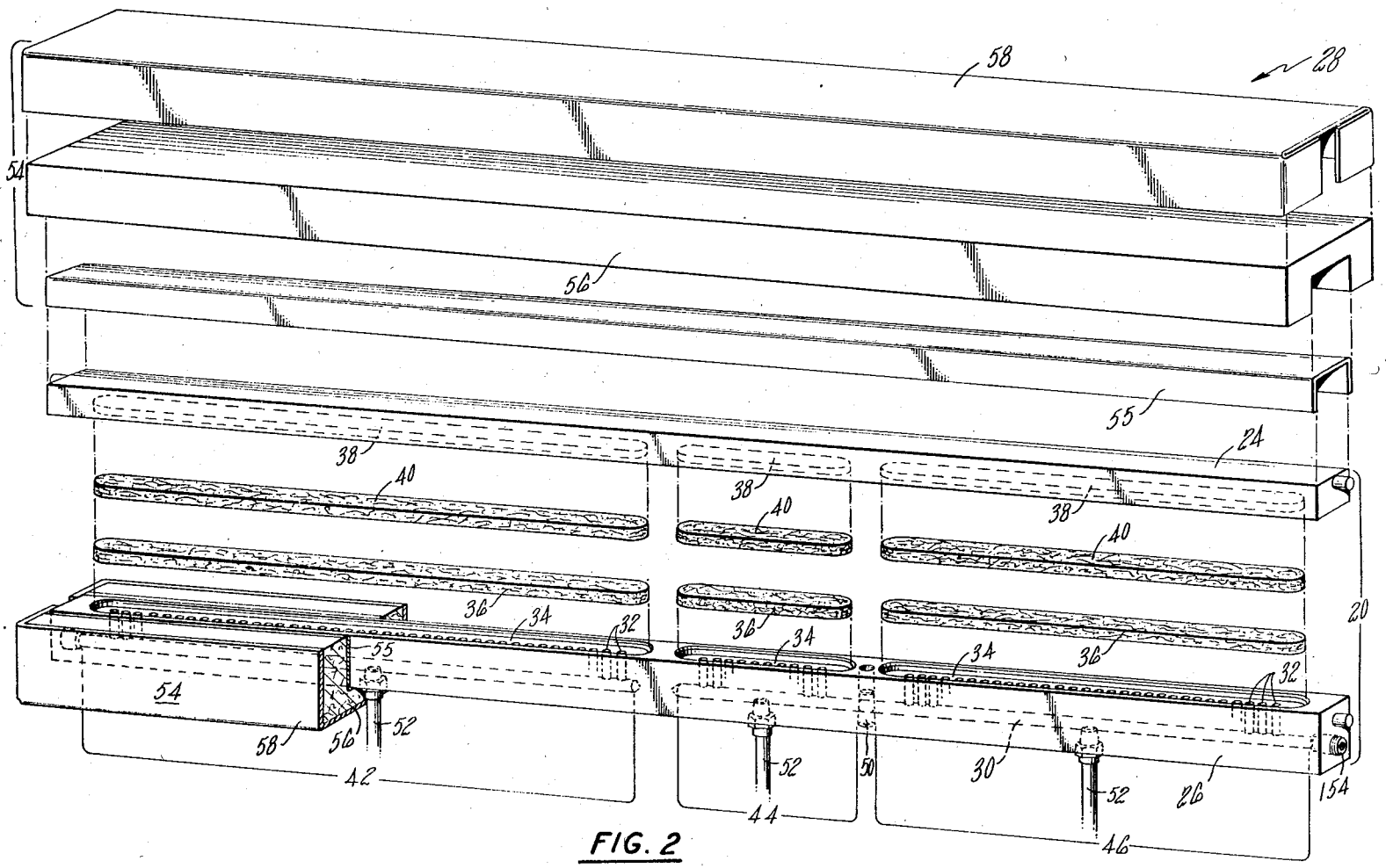
FIG. 2 shows an exploded view partly broken away and partly in section of the applicator die.

The wires coated according to the present invention are conventional magnet wire substrates, e.g. copper or aluminum and while not limited to any particular size, are typically wires ranging anywhere from 20 AWG (0.032 inch) to 50 (0.001 inch) AWG (American Wire Gauge) in diameter, with wire sizes about 25 AWG (0.018 inch) to about 46 AWG (0.0016 inch) being the most preferred wire. Wire coatings anywhere from about 0.05 mil to about 3 mils in thickness can be applied. Typically, the coating is applied in a series of passes, each pass adding another layer of enamel onto the wire. Typically, with wires of this diameter, each pass will apply about 0.025 mil to about 0.25 mil and most typically, it will be 0.15 mil. The amount of material placed on the wire at any one pass will, of course, be a function of the type of coating composition used and its viscosity. In addition, the method can be configured for a single coat material, two-coat materials and three-coat materials, systems, etc, each coating material being a different polymeric material with a separate felt pad for each material all located in the same applicator die.

These coatings can be used as a sole insulation coat or part of a multi-coat system in combination with other conventional polymer insulation. Typically, these wires are coated with polyurethane base coats, however, THEIC polyester base coats may also be applied (note U.S. Pat. Nos. 3,342,780; 3,249,578; and also commonly assigned U.S. Pat. No. 4,476,279 the disclosures of which are incorporated by reference) with polyamide or polyamideimide overcoats. Other polymers useful with the present invention include polyester, polyamideimide, polyamide, polyurethane, polyepoxide, polyesterimide, polyimide and polyvinyl formal (note U.S. Pat. No. 4,374,221). The important physical feature of the polymers selected for these coatings is that they be capable of having their viscosities lowered to below 200 cps through heating without deteriorating the final enamel. The base coat to topcoat ratios are from 60–90:40–10.

The polymers of the present invention can also contain lubricants either externally on the coating, internally in the coating or both. A typical external lubricant comprises equal amounts of paraffin, beeswax and vaseline in roughly equal amounts applied out of conventional solvents. The enamels can be cured by passing through conventional curing ovens with typical inlet oven temperatures of about 400° F. (204° C.) to about 900° F. (482.2° C.), preferably about 600° F. (315.5° C.) and outlet temperatures of about 500° F. (260° C.) to about 1100° F. (593.3° C.) and preferably about 650° F. (343.3° C.). However, other enamels may be developed which require higher or lower curing temperatures and may also be used if their viscosities can be lowered to the requisite cps without ruining the resin.

As stated above, the solids content of the polymers should be about 6% to about 100% by weight. There is virtually no limit on the viscosity or solids content of the enamel used, so long as its viscosity can be lowered by heating the enamel to less than about 200 cps and will maintain that viscosity until applied to the substrate. Enamels having viscosities as high as 120,000 cps or greater at 86° F. (29.7° C.), may be employed using this invention. In addition to heating the enamel prior to applying it to the wire substrate, the applicator die and the hoses used to transport the heated enamel to the die may also be heated to maintain the desired viscosity. The wire itself may be heated as well, although this is not a requirement. In addition to maintaining the viscosity of the enamel, the elevated temperatures will also reduce the energy required to cure the enamel in the ovens.

The present invention overcomes the high solids/-high viscosity dilema by preheating the enamel to a temperature which reduces its viscosity to an acceptable level and substantially maintains that viscosity during its application onto the wire, but does not lower the solids content. Typically, the enamel is heated to temperatures ranging from about 120° F. (48.9° C.) to about 300° F. (148.9° C.), thereby reducing the viscosity to below about 200 cps. However, these temperatures should not be limiting as the enamel may be heated to any temperature which does not cause it to react prematurely so as to result in an unacceptable final product, or to a product where the solvent is boiled or driven off prematurely, thereby increasing the viscosity to an unacceptably high level. The enamel may be maintained at the desired temperature by heating the enamel in a reservoir and also heating the applicator die as well as any connecting hoses and tubing which may be used to transport the enamel as stated above. As has been used in the past, felt pads are used to wick the heated enamel from a manifold to the wire and aid in applying a smooth uniform coat. This method allows for increased wire speeds and greater amounts of enamel being applied to the wire per pass, requiring fewer passes to attain a desired thickness.

As may be seen in FIG. 1, the wire 2 is passed into the applicator die 28 whereupon through contact with the felt applicators 36 and 40, it is coated with a substantially uniform, concentric film of wire enamel. The coated wire 9 then exits the applicator die 28 and passes through a curing oven 10, where the enamel is cured. A typical pass such as just described will, depending on the size of the wire and the type of enamel, deposit between 0.025 mil and 0.25 mil of coating onto the wire with about 0.15 mil to about 0.2 mil being most typical. Typical oven temperatures have been cited above, however these may vary depending on the particular enamel used. The cured coated wire 12 is then advanced about the top sheave 14 to the bottom sheave 16 (thereby advancing it to a different position within the applicator die) and again to the applicator die 28 (by conventional manner), wherein another layer of the same or different enamel is applied to the wire which is again cured by passing it through the curing oven. This process is performed a number of times until the desired thickness and layers of material have been reached.

The sheaves and ovens for passing the wire through the system are conventional. The novel features of the system are contained in the process of applying the enamel. As may be seen in FIG. 2, the applicator die 28 is comprised of a die body 20 in the form of a top half 24 and a bottom half 26. The body may be made of conventional materials, i.e. aluminum, steel, etc. as long as they are not subject to attack by typical enamel solvents. The bottom half 26 contains at least one manifold 30 machined into the body of the die into which the enamel can flow. The Figure depicts a die having three (3) separate manifold sections 42, 44 and 46, wherein a plug 50 may be inserted or removed between manifold 44 and 46 to form a single or a double manifold. Each manifold has a separate enamel feed line 52, through which the heated enamel is fed into the manifold for wicking to the felt 36. This manifold is typically machined into the bottom half of the die, however, it could just as easily be in the top half or both halves as well. The manifold also is typically directed in a longitudinal direction through the die body and is plugged by a threaded plug 154. A series of holes 32 connect the manifold with a chamfered inset 34 into which a bottom felt cutout applicator 36 is positioned. The felt pad 36 then wicks the enamel from the manifold 30 through the holes 32 to the wire (not shown) which is in contact with the felt pad. The top half of the die 24 is a solid mating piece to the bottom half 26, having insets 38 for positioning a mating top felt pad cutout 40 to the bottom half felt pad 36. The top half felt pads 40 contact the bottom half felt pads 36 when the die applicator is positioned about the wires and the enamel is then wicked from the bottom felt pads 36 to the upper felt pads 40, thereby affording complete coverage of the wire with the enamel. Although it is desirable to have the felt pads cut to fit snuggly into both the top and bottom insets, it is not critical. The most critical dimension which has been determined is that the width of the felt pads fit snuggly into the insets and may even be slightly oversized. The length need not fill the entire inset, in fact, the wicks used were rectangular in shape while the chamfered insets at the ends were rounded, thereby leaving the most extreme portions unfilled. However, this invention should not be limited to these situations as any shape felt pad may be used which will function to wick the enamel from the manifold onto the wire substrate.

The felt pads which may be used to practice this invention may be any of the commercially available felt pads such as wool, acrylic, polypropylene, polyester, etc. These felt pads should have a density when compared to woolen felt pads of about F-1 to about F-10 with a density of about F-5 being preferred. This is equivalent to a specific garvity of about 0.181 gm/cc to about 0.342 gm/cc bsed on a 100% wool sample.

The woolen felt pads may be either pressed felt pads or woven structures while the synthetic felt pads are generally needled.

The die body is then covered on three sides with a heating element layer 54. Typically, this is in the form of a tape 55 with the preferred heating tape being made of two layers of Kapton® film sandwiched about a fluorinated polymer. The reason for using this particular tape is that it is resistant to the enamel solvents present during operation, thereby reducing frequency of replacement or repair. The tape 55 is typically bonded to the die with a fluorosilicone adhesive. A layer of insulation 56 (typically $\frac{3}{8}$ inch in thickness), is then placed about the die to help maintain a constant temperature within the die during operation and a protective cover 58 (typically of aluminun) is then placed over the insulation. The tape, adhesive and insulation are all conventional. All of the materials used in this process should be resistant to attack by the enamel solvents thereby increasing their operational life and reducing frequency of repair or replacement. The sides are similarly insulated as shown in FIG. 3 as the tape 55, the insulation 56 and a protective cover 58 are bonded to both sides. The insulation and heating tape should not restrict the passage of the wire through the applicator die.

FIG. 3 is a cross section through the applicator at one of the enamel input points 52. During the operation, the die applicator is placed about the wires 2 so that the wires 2 are surrounded by the felt pads 36 and 40 and a uniform coating will be applied. In this Figure, the enamel is maintained in a separate reservoir 100 which is heated, using conventional heating and temperature monitoring equipment to the desired temperature, and maintained at that temperature throughout the process. The enamel is then fed through a heated hose 102 typically by pump 104 and fittings 106 to the applicator die 20, which is also heated. All of the components which contact the heated enamel, hoses, applicator, etc., should be maintained at the optimum temperature to allow for maintenance of the proper viscosity and uniform application to the wire. Typically these temperatures will range from about 120° F. (48.9° C.) to about 300° F. (148.9° C.).

This process has been successfully employed to apply enamels having viscosities as high as 1000 cps at 14.2% whereas prior art enamels have viscosities in the 40 cps range.

EXAMPLE

An applicator system of the type described above was constructed. The system was designed to apply two different enamels onto a single magnet wire 6 mils in diameter. The applicator die was constructed as shown in FIG. 2 with two aluminum disections and felt pads which were purchased from Southeastern Felt Corporation as F-S Wool $\frac{3}{8}\times\frac{3}{8}\times$L and having a density of 0.262 based on 100% wool. The felt pads, which were about $\frac{3}{8}$ inch thick, were cut into rectangles which were to fit the chamfered insets in the die body in a conventional manner. The two enamels which were to be applied to the wire were Nylon 6,6 resin available from Monsanto Industrial Chemicals Co. and others, and containing about 14.2% solids by weight and having a viscosity of 480 cps at 86° F. (30° C.). The second enamel was thermoplastic, a polyvinyl butyral resin also available from Monsanto Industrial Chemicals Co. and also containing 14.2% by weight and having a viscosity of 1000 cps at 86° F. (30° C.).

Each of these enamels was heated in a separate reservoir to the desired temperature where the viscosity would be such that application through the felt onto the wire would be smooth, fast and uniform both in thickness and in concentricity. It was determined that the nylon enamel should be heated to about 160° F. (71.1° C.) to lower its viscosity to about 43 cps and that the Butvar TM should be heated to about 150° F. (65.5° C.) to lower its viscosity to 94 cps. The heating was performed in large, about twenty gallon containers wrapped with conventional heating coils and conventional thermal control apparatus being used to maintain a temperature. The hoses (No. 212-10-4 hoses available from Technical Heaters Corporation) which transported the heated enamel to the heated applicator die contained heating elements in them and the temperature was maintained at 159.7° F. (71° C.) for the nylon enamel transport and 120° F. (49° C.) for the Butvar TM enamel transport. In this example, the manifold containing the nylon enamel was maintained at 156° F. (69° C.) while the Butvar TM manifold was maintained at 148° F. (64° C.). These temperature ranges were attained by heating the applicator die enough to compensate the different heat transfer properties of each enamel and the different flow rates, to maintain each manifold section at the desired temperature.

The particular flow of the Butvar TM was 32.9 cc/min while the nylon enamel was about 7.6 cc/min.

The wire, which had already had a 0.5 mil polyurethane coating applied to it using in the conventional low solids techniques, was first passed through the applicator portion containing the nylon enamel and contacting the felt applicator which applied the enamel in a thickness which ranged from about 0.05 to about 0.10 mils. The wire was then passed through a conventional curing oven whose temperature was about 543° F. (281° C.) at the inlet and about 573° F. (297° C.) at the outlet. The residency time of the enamel in the oven was about 1.5 seconds as the wire speed throughout the system was 400 feet per minute. The cured, coated wire was then passed through the applicator a second time and a layer of Butvar TM material about 0.03 to about 0.16 mil was applied to the coated wire which was then passed through the same oven and cured again. The wire was then again returned to the die applicator for a second and third coating of the Butvar TM material which were again subsequently cured in the oven after each pass. This resulted in a wire having an overall coating of about 0.0001 inch of Nylon 6,6 coating and about 0.0003 inch of the Butvar TM.

Although one particular configuration is described herein, other configurations and modifications to the process may be performed without extending beyond the scope of the invention.

This invention offers a number of advantages over the prior art. As has been stated above, it is desirable to use high solids coating compositions due to the reduced solvent costs and lower environmental hazards. However, the higher solids enamels also allow for increased coating build per wire pass through the applicators, reducing the number of passes required to coat a wire by as much as 44% or higher. This high enamel buildup per pass also results in an increase in productivity as it allows for a greater number of wires to be processed in a fixed operational area. Also, this technique allows for faster wire travel through the coating process, this increase may be 8% or higher, due to lower solvent evaporation time, increasing productivity.

Additionally, the final coated wire is of higher quality with reported defects in coils produced by this wire reduced by as much as 73%.

It should be understood that the invention is not limited to the particular embodiments shown and described herein, but that various changes and modifications may be made without departing from the spirit and scope of this novel concept as defined by the following claims.

We claim:

1. A method for applying a polyvinyl butyral magnet wire enamel coating to magnet wire comprising:

heating a high solids polyvinyl butyral enamel coating material to reduce its viscosity to about 200 cps or less, introducing the heated coating material into a heated applicator die wherein the heated coating material is wicked onto felt applicators, passing a wire through the heated applicator and contacting said wire with the felt applicators, thereby coating the wire with a layer of enamel from about 0.03 to about 0.16 mil thick, passing the coated wire through a means for curing the enamel coating forming the enamel coated magnet wire, wherein the enamel viscosity is maintained below 200 cps until applied to the wire, resulting in reduced defects in coils containing such wire.

2. The method of claim 1 wherein the magnet wire is passed through the heated enamel applicator die two or more times, resulting in a multilayered enamel coated magnet wire.

3. The method of claim 1 wherein the magnet wires range from American Wire Gauge 25 to American Wire Gauge 50.

4. The method of claim 1 wherein the magnet wire has been coated with one or more layers of a polyester, polyamide, polyamideimide, polyurethane, polyepoxide, polyesterimide, polyimide or polyvinyl formal.

5. The method of claim 1 wherein the magnet wire has been coated with a layer of polyurethane resin and then a layer of polyamide resin.

* * * * *